US007506410B2

(12) United States Patent
Minter

(10) Patent No.: US 7,506,410 B2
(45) Date of Patent: Mar. 24, 2009

(54) APPARATUS FOR STRIPPING FIBRE MATERIAL FROM TEXTILE FIBRE BALES OF SPINNING MATERIAL, FOR EXAMPLE COTTON, SYNTHETIC FIBRES AND THE LIKE

(75) Inventor: Franz-Josef Minter, Mönchengladbach (DE)

(73) Assignee: Truetzschler GmbH & Co. KG, Moenchengladbach (DE)

( * ) Notice: Subject to any disclaimer, the term of this patent is extended or adjusted under 35 U.S.C. 154(b) by 452 days.

(21) Appl. No.: 11/368,382

(22) Filed: Mar. 7, 2006

(65) Prior Publication Data

US 2006/0207064 A1 Sep. 21, 2006

(30) Foreign Application Priority Data

Mar. 18, 2005 (DE) ..... 10 2005 013 076

(51) Int. Cl.
*D01G 15/40* (2006.01)

(52) U.S. Cl. ..... 19/97.5; 19/105

(58) Field of Classification Search ..... 19/80 R, 19/97.5, 105

See application file for complete search history.

(56) References Cited

U.S. PATENT DOCUMENTS 4,587,691 A 5/1986 Hösel
5,179,763 A 1/1993 Zander et al.
5,189,308 A * 2/1993 Kortlang et al. ..... 250/559.37
5,285,552 A * 2/1994 Leifeld et al. ..... 19/80 R
5,933,921 A * 8/1999 Jossi ..... 19/80 R
6,497,008 B1 * 12/2002 Schlepfer et al. ..... 19/80 R

FOREIGN PATENT DOCUMENTS

DE 32 06 257 C2 9/1983
DE 37 22 31 C2 1/1989
DE 3722317 A1 1/1989
DE 696 10 540 T2 6/2001
EP 0 156 991 A1 10/1985
EP 0 415 156 A1 3/1991

OTHER PUBLICATIONS

British Search Report, dated Jul. 5, 2006, based on corresponding British Application No. GB0604595.9.

* cited by examiner

*Primary Examiner*—Shaun R Hurley
(74) *Attorney, Agent, or Firm*—Venable LLP; Robert Kinberg; Justine A. Gozzi

(57) ABSTRACT

An apparatus for stripping fiber material from textile fiber bales has a tower, which can be moved to and fro in relation to the fiber material by means of a carriage having a travel motor or the like, and has at least one boom, which is provided with the stripping apparatus. The boom together with the stripping apparatus can be moved in the height direction of the tower by means of a lifting motor or the like. A movable distance sensor is provided for determination of the location in the length direction. In order to make possible, by simple means, an exact determination of location in the length and/or height direction, a movable distance sensor scans, for location determination in the length and/or height direction, the distances to a counterpart element and calculates from those distances the location.

21 Claims, 5 Drawing Sheets

Fig. 2a
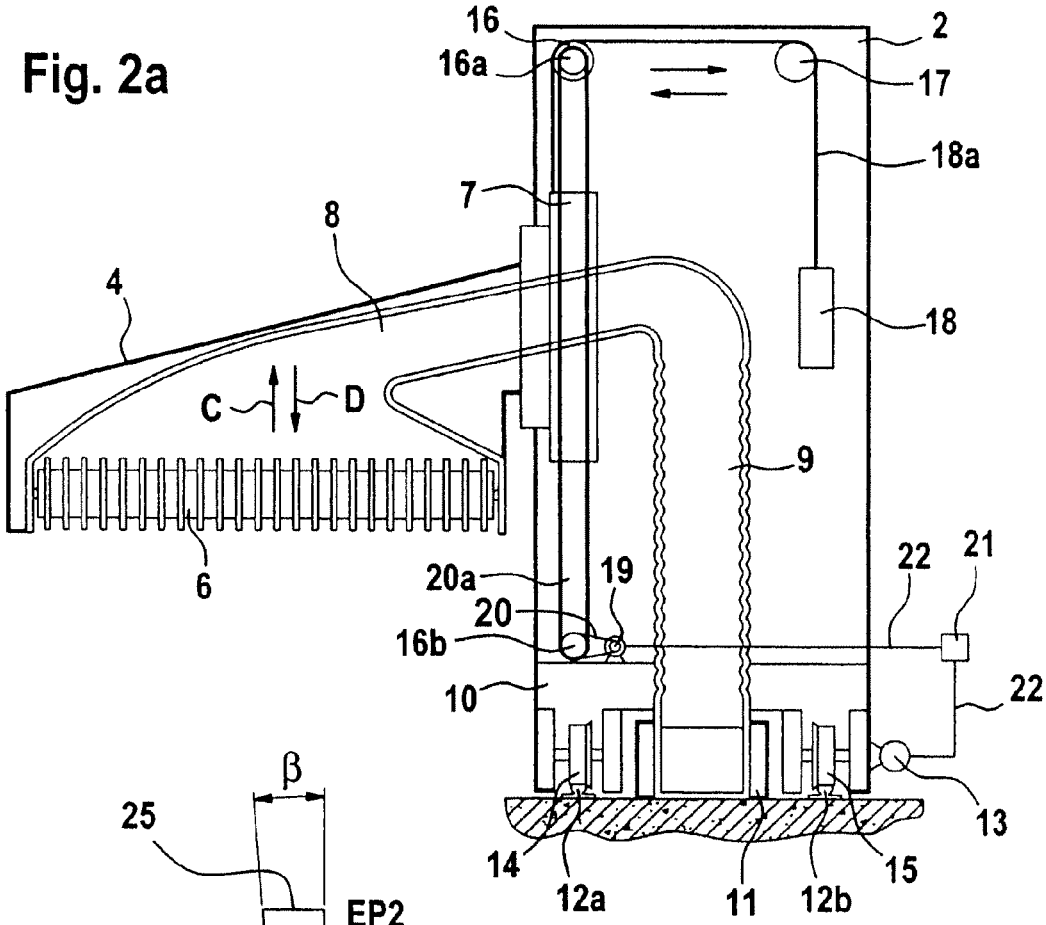
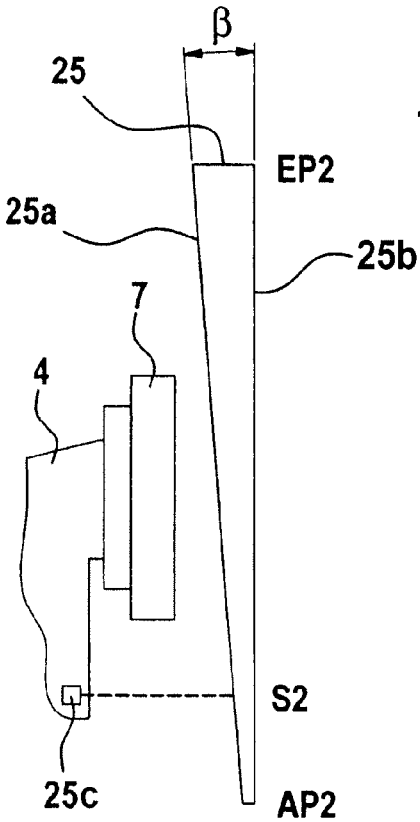
Fig. 2b

APPARATUS FOR STRIPPING FIBRE MATERIAL FROM TEXTILE FIBRE BALES OF SPINNING MATERIAL, FOR EXAMPLE COTTON, SYNTHETIC FIBRES AND THE LIKE

CROSS REFERENCE TO RELATED APPLICATION

This application claims priority from German Patent Application No, 10 2005 013 076.3 dated Mar. 18, 2005, the entire disclosure of which is incorporated herein by reference.

BACKGROUND OF THE INVENTION

The invention relates to an apparatus for taking-off fibre material from textile fibre bales of spinning material, for example cotton, synthetic fibres and the like, by means of a stripping apparatus or the like, wherein a tower, which can be moved to and fro in relation to the fibre material by means of a carriage, which has a travel motor or the like, has at least one boom, which is provided with the stripping apparatus and which extends in a transverse direction to the direction of movement, and the boom together with the take-off apparatus can be moved in the height direction of the tower by means of a lifting motor or the like.

In a known apparatus (DE-A- 37 22 317), the take-off apparatus is provided with sensors which register the distance of the take-off apparatus from a wall or the like where the row of bales terminates. Control lines lead to a switch-over device or to a control unit by means of which the take-off apparatus can be reversed at the end of the movement of the take-off apparatus. The sensors are proximity sensors which initiate the slowing-down or reversal procedure in good time before the wall is reached. Using those sensors it is not possible to ascertain the location of the carriage exactly. In addition, it is disadvantageous that the sensors have to act over a relatively large distance in the horizontal direction in order that the travel speed of the heavy machine resulting from the substantial weight of the carriage and the tower together with the boom, for example 2.8 tonnes, can be reliably slowed down in good time without damage. A sensor that acts in the height direction is not provided because neither a slowing-down procedure nor a reversal procedure is carried out in the height direction.

It is an aim of the invention to provide an apparatus of the kind described at the beginning that avoids or mitigates the mentioned disadvantages and that especially makes possible, by simple means, a substantially exact determination of location in the length and/or height direction.

SUMMARY OF THE INVENTION

The invention provides an apparatus for removing fibre material from textile fibre bales, comprising:

a carriage that is movable in a height direction and a length direction for stripping fibre material from the fibre bales;

a distance sensor that is movable with the carriage; and a counter-surface;

wherein the distance between the distance sensor and the counter-surface varies in use according to the location of the carriage and the distance sensor is arranged to scan the distance to the counter-surface for determining a location of the carriage.

As a result of the fact that an optical distance sensor scans a counter-surface, especially a sloping surface, for example a ramp or the like, large distances are calculated very exactly by means of relatively small distance measurements. It is especially advantageous that for measurement of just small distances economically priced distance sensors can be used. In addition, distance measurement performed over a short distance is more exact (focussed) because scattered light losses are minimised. Mounting of the optical distance sensors is simple. Overall, position detection (location determination) that is maintenance-free and free from wear is made possible. Irrespective of the position and the work region in which the machine is located, the control (evaluation device) calculates the position (location) of the lower carriage or removal device immediately after the machine has been switched on. Finally, no slippage is present.

Advantageously, the counterpart element is a ramp or the like. Advantageously, the counterpart element is generally elongate. Advantageously, the counterpart element has a flat scanning surface. Advantageously, the scanning surface is capable of reflecting beams of light. Advantageously, the distance sensor is a light scanner. Advantageously, the distance sensor has a transmitter and a receiver. Advantageously, the distance sensor is a laser scanner. Advantageously, the distance sensor uses visible light. Advantageously, the distance sensor uses infra-red light.

Where the position in the lengthwise direction relative to the bales is to be determined, the distance sensor for the length direction may be mounted on the movable carriage, or on the tower. Advantageously, the counterpart element for the length direction is associated with the spinning room floor. Instead, the counterpart element for the length direction may be mounted on the suction duct for the removed fibre material. Advantageously, a counterpart element is provided on both sides of the carriage.

Where the position heightwise is to be determined, the distance sensor for the height direction may be mounted on the movable stripper. A counterpart element for the height direction may be mounted on the tower.

Advantageously, the distance sensor for location determination in the length direction is mounted at an angle of 90° to the horizontal base surface of the counterpart element.

Advantageously, the distance sensor for location determination in the height direction is mounted at an angle of 90° to the vertical base surface of the counterpart element.

Advantageously, a movable cleaning element, for example a brush, cleaning lip or the like, is associated with the sloping surface. Advantageously, the distance sensor and the counterpart element are arranged in an enclosed housing. Advantageously, the distance sensor is in communication with an electrical evaluation device. Advantageously, the evaluation device is in communication with an electronic control and regulation device. It is preferred that the evaluation device, given a prespecified distance between the distance sensor and the base surface of the counterpart element and a prespecified angle of inclination, can calculate the location from the distance between the distance sensor and the sloping surface of the counterpart element. Preferably, the function of the dependence of the location on the distance of the distance sensor from the sloping surface is stored in a memory. Advantageously, the distance sensor is a sensor that operates in an analogue manner.

In one embodiment, a stationary distance sensor is arranged opposite the wound-on part of the covering band for the suction duct for the removed fibre tufts. The counterpart element may be arranged on the suction duct. At least one counterpart element may be arranged to the side of the suction duct. In certain embodiments, a sloping surface is produced by machining, for example milling or the like, carried out on a structural element of the machine. Advantageously, an optical distance sensor scans the distances to a sloping surface of the counterpart element.

The invention also provides an apparatus for stripping fibre material from textile fibre bales of spinning material, for example cotton, synthetic fibres and the like, by means of a milling apparatus or the like, wherein a tower, which can be moved to and fro in relation to the fibre material by means of a carriage, which has a travel motor or the like, has at least one boom, which is provided with the milling apparatus and which extends in a transverse direction to the direction of movement, and the boom together with the stripping apparatus can be moved in the height direction of the tower by means of a lifting motor or the like, a movable distance sensor being provided for determination of the location in the length direction, in which, for location determination in the length and/or height direction, a movable optical distance sensor scans the distances to a counterpart element that is immovable relative to the distance sensor and that is arranged at an angle relative to the length and/or height direction, respectively.

Furthermore, the invention provides a method for stripping fibre from an upper surface of a row of fibre bales, comprising moving to and fro over said upper surface a stripping device, determining the position of the stripping device by means of determining a spacing between a movable sensor associated with the stripping device and an immovable inclined surface and calculating the position therefrom, and controlling the movement of the stripping device in dependence on the determined position.

BRIEF DESCRIPTION OF THE DRAWINGS

FIG. 2*a* is a diagrammatic front view of the apparatus according to FIG. 1*a;*

FIG. 2*b* shows the boom together with the distance sensor and a counterpart element in ramp form;

DETAILED DESCRIPTION OF CERTAIN PREFERRED EMBODIMENTS

Figure 1A:
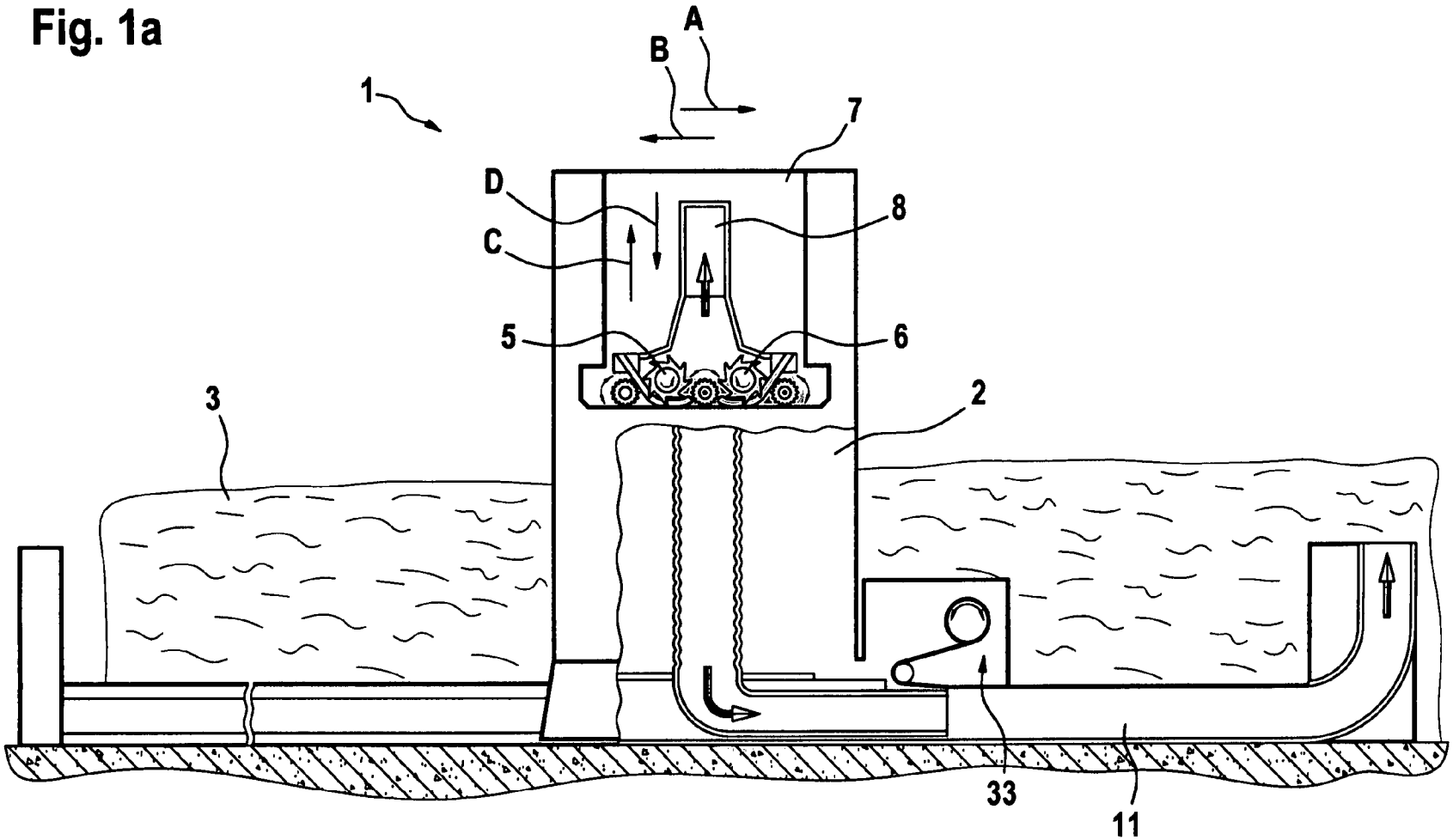
FIG. 1*a* is a diagrammatic side view of an apparatus according to the invention, at a bale opener having a location-modifiable distance sensor and a stationary counterpart element, for location determination in the length direction.

With reference to FIGS. 1*a* and 2*a*, an apparatus 1 for stripping fibre tufts, for example a bale opener known as BLENDOMAT BDT 019 (Trade Mark), made by Trutzschler GmbH & Co. KG of Monchengladbach, Germany, has a tower 2 on a carriage 10, which travels to and fro in the direction of arrows A, B parallel to a row of bales 3. On one side of the tower 2, a laterally cantilevered take-off element 4 is connected to the tower 2. The take-off element 4 comprises two take-off rollers 5, 6 (high-speed stripping rollers) that rotate in opposite directions. The take-off element 4 is mounted on the movable tower 2 by way of a holding device 7. The fibre tufts taken off by the stripping rollers 5, 6 are drawn off under suction through a material removal port 8 and a suction line 9, which co-operates with a suction duct 11. The surface of the row of bales 3 is stripped horizontally. The take-off element 4 having the associated stripping device is mounted on the tower 2 so as to be movable in the height direction in accordance with arrows C, D.

Figure 1B:
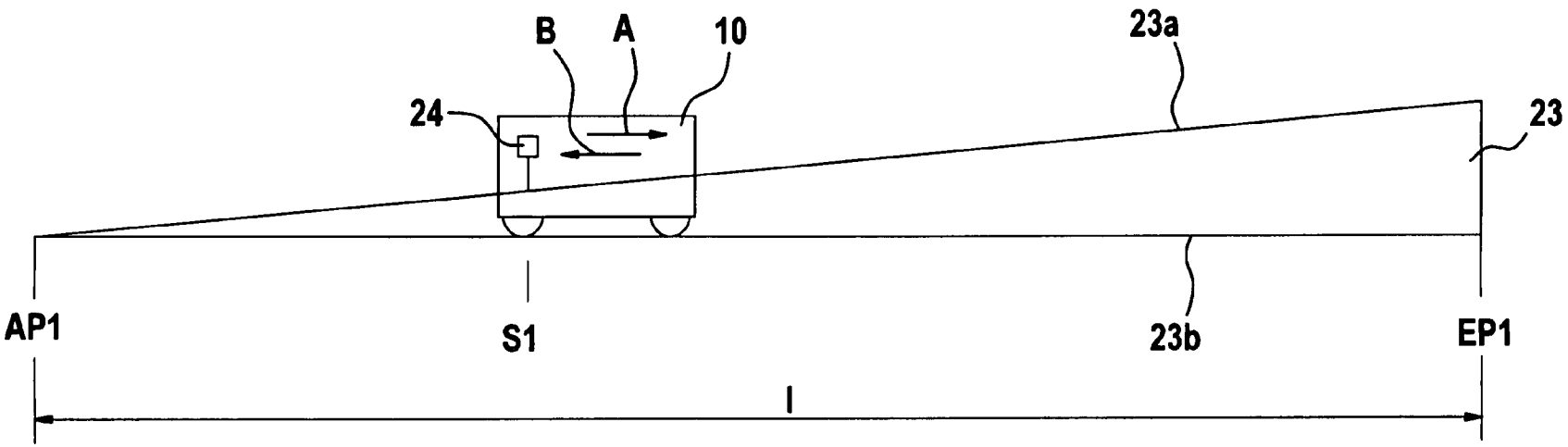
FIG. 1*b* shows the carriage of FIG. 1 together with the distance sensor and a counterpart element in ramp form.
Figure 1C:
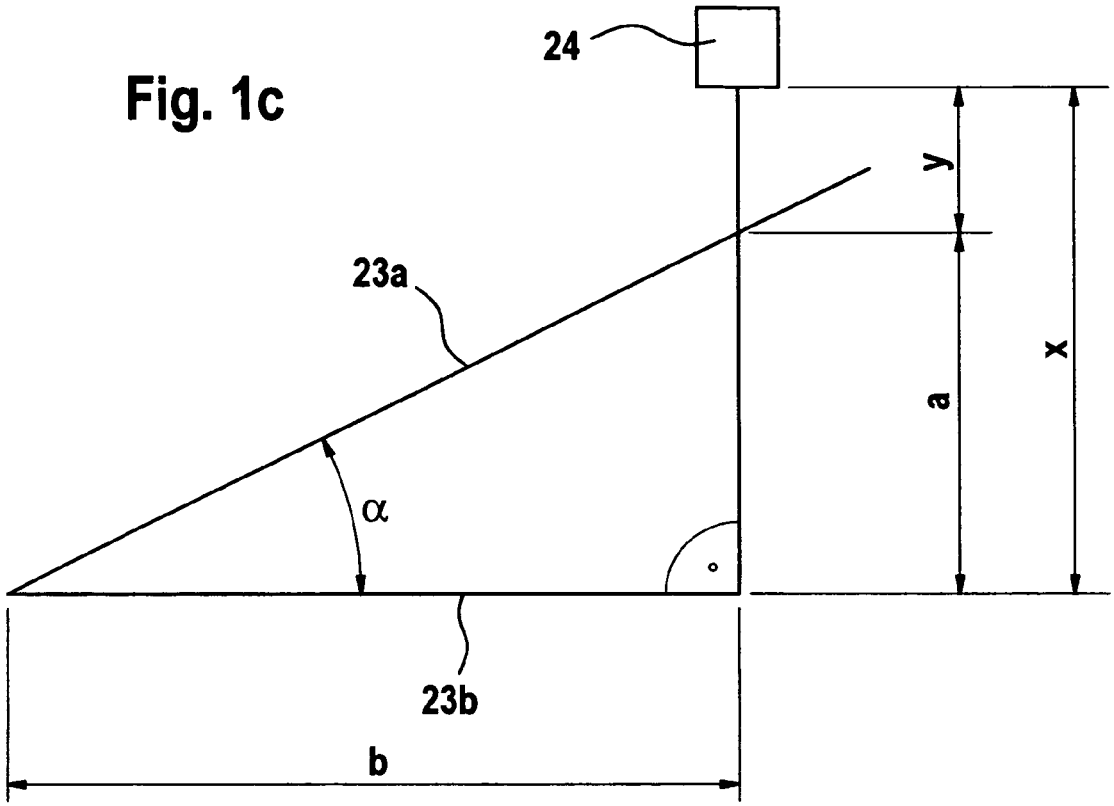
FIG. 1*c* shows the distance between the distance sensor and the base surface of the counterpart element in FIG. 1, the angle of inclination of the ramp between the base surface and the sloping surface, the distance between the distance sensor and the sloping surface, the difference between the distances of the distance sensor from the base surface and from the sloping surface, and the distance of the location from a starting point.
Figure 1D:
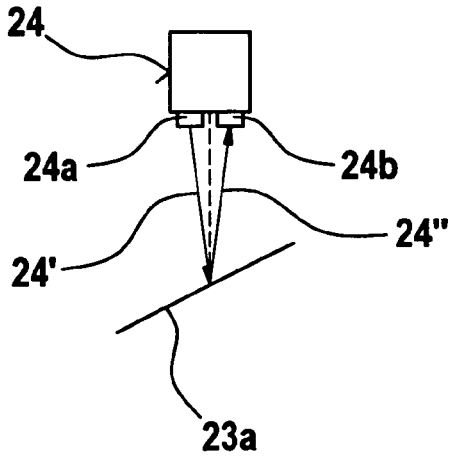
FIG. 1*d* shows the distance sensor, having a transmitter and receiver.

Referring to FIG. 1*b*, there is arranged on the spinning room floor a stationary ramp 23 which has a horizontal base surface 23*b* and a sloping surface 23*a* arranged at an acute angle α (see FIG. 1*c*) to the base surface 23*b*. The ramp 23 is arranged to the side of the carriage 10 and the suction duct 11. The length 1 extends over the length of the machine and is greater than the length of the row of bales 3, for example 30 m. Mounted on the side of the carriage 10, which is movable in the direction of arrows A, B, and above the sloping surface 23*a* is an optical distance sensor 24, for example an infra-red sensor, the beam path of which is directed at the sloping surface 23*a*. AP1 denotes the starting point, S1 denotes the location and EP1 denotes the end point. FIG. 1*c* shows calculation of the location S1, wherein:

x=distance between the distance sensor 24 and the base surface 23*b,*

α=angle of inclination between the base surface 23*b* and the sloping surface 23*a,* y=distance between the distance sensor 24 and the sloping surface 23*a,* a=difference between the distances of the distance sensor 24 from the base surface 23*b* and from the sloping surface 23*a,* b=distance of the location S1 from the starting point AP1.

The values of x and α are fixed, prespecified values. The values of y, a and b are dependent on the location S1. The straight lines a and b are arranged at a right angle with respect to one another. Calculation of the value of b and, as a result, the location S1 is carried out in three calculation stages:

$$x - y = a$$

$$\tan\alpha = \frac{a}{b} b = \frac{a}{\tan\alpha}$$

Figure 4:
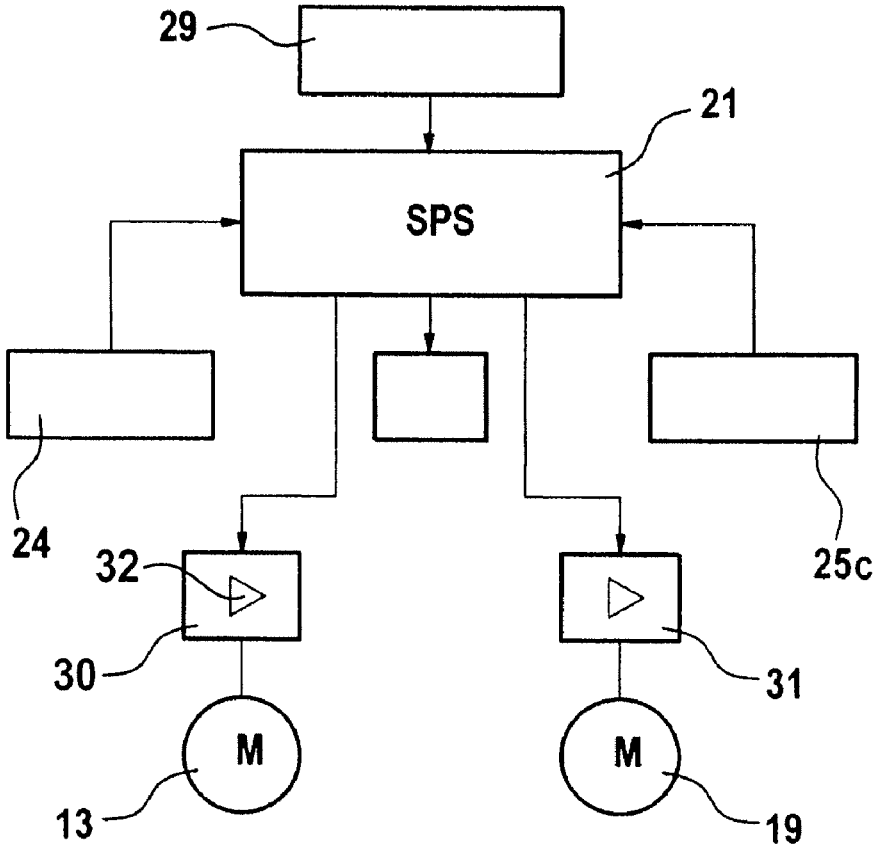
FIG. 4 is a diagrammatic block diagram having an electronic control and regulation device, a distance sensor for the length direction, a distance sensor for the height direction, a travel motor and a lifting motor.

The calculation is performed in the electronic control and regulation device 21, for example a microcomputer (see FIG. 4).

The distance sensor 24 (light scanner) consists of a light transmitter 24*a* and a light receiver 24*b*. The beam of light 24' emitted by the light transmitter 24*a* is reflected by the smooth surface of the sloping surface 23*a*, and the reflected beam of light 24" is received by the light receiver 24*b*.

In accordance with FIG. 2*a*, the carriage 10, together with the tower 2, is movable to and fro along rails 12*a* and 12*b* in the directions A, B. Reference numeral 13 denotes a travel motor for driving the travel wheels 14, 15 of the carriage 10, together with the tower 2, in the length direction. The holding device 7 supporting the take-off element 4 is suspended from a counterweight 18 by way of a cable 18*a* passing around guide rollers 16, 17, a lifting motor 19 enabling the height of the removal element 4 to be changed by means of transmission elements 20, 20*a* (for example, chains) and the guide rollers 16*a*, 16*b* (for example, chain wheels). The displacement path of the take-off element 4 in the height direction (arrows C, D) and the lengthwise movement (arrows A, B) of the carriage 10 together with the tower 2 resulting from the travel motor 13 are matched to one another by means of a control device 21 and control lines 22. The take-off element 4 is fastened to the holding device 7. The tower 2 is arranged on the carriage 10 so that it is rotatable about a vertical axis. The suction line 9 opens out into a suction duct 11 located in a stationary position on the floor between the rails 12*a*, 12*b*.

Referring to FIG. 2*b*, there is mounted on the tower 2 a ramp 25, which has a vertical base surface 25*b* and a sloping surface 25*a* arranged at an acute angle β to the base surface 25*b*. The ramp 25 is mounted on the side of the tower 2 (see FIG. 2*a*). Mounted on the side of the take-off element 4 is an optical distance sensor 25*c*, for example a laser sensor, the beam path of which is directed at the sloping surface 25*a*. AP2 denotes the starting point, S2 the location and EP2 the end point. Calculation of the location point S2 is carried out in a manner corresponding to that described and shown with reference to FIG. 1*c*.

The sensor 25*c* can also be mounted (in a manner not shown) on the holding device 7 inside the housing of the tower 2, and the ramp 25 can (in a manner not shown) be mounted inside the housing, for example on a vertical support or the like. In that embodiment, the sloping surface can be arranged on a vertical steel support, for example it can be machined into the latter by means of milling.

Figure 3:
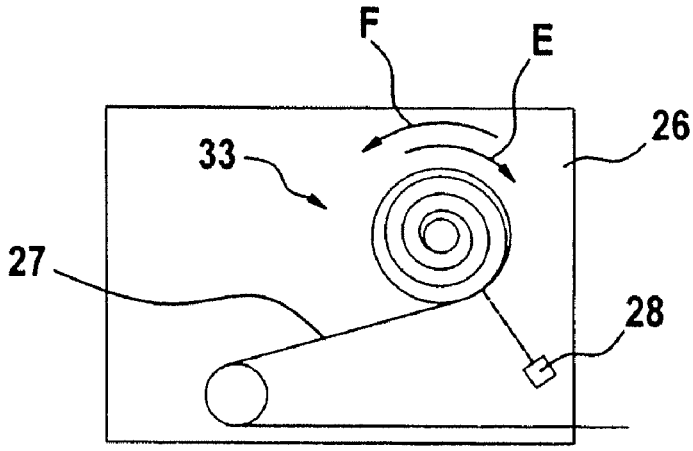
FIG. 3 shows a further embodiment of the invention, wherein a distance sensor is located opposite a partially wound-on or unwound covering band.

With reference to FIG. 3, there is arranged, in a housing 26, a scrolled band covering 33, which is known, for example, from DE 32 06 257 A. The housing containing the scrolled band covering 33 is provided above the suction channel 11 (see FIG. 1*a*). Opposite the wound-on part (as seen in the direction of E) or unwound part (as seen in the direction of F) of the band 27 is a stationary distance sensor 28, which ascertains, by means of scanning, the increasing or decreasing diameter of the wound-on or unwound part of the band 27. The location of the carriage 10 in the length direction can be determined by means of the distance sensor 28.

In an embodiment shown in FIG. 4 there is provided an electronic control and regulation device 21, for example a programmable-memory control, to which there is connected an input device 29. Electronically connected to the control device 21 are a path recognition device for the length direction, for example the distance sensor 24, on the carriage 10 and a path recognition device for the height direction, for example the distance sensor 25*c*, on the take-off element 4. The control device 21 is also in electronic communication with the travel motor 13 by way of an amplifier (control electronics unit, frequency converter) 30 and with the lifting motor 19 by way of an amplifier 31. Reference numeral 32 denotes a display device on which the ascertained locations S1 and/or S2 are visually displayed.

It will be understood that a recognition device for the length, for example a device as described with reference to FIG. 1*b* or a device as described with reference to FIG. 3, may advantageously be provided in combination with a recognition device for the height, for example a height recognition device as described with reference to FIG. 2*b*. Thus, the embodiment of FIG. 4 includes a length recognition device according to FIG. 1*b* and a height recognition device according to FIG. 2*b*. The length recognition devices of FIGS. 1*b* and FIG. 3 may, however, also be provided independently of the height recognition device of FIG. 2*a*, with or without any other kind of height recognition device. Likewise, the height recognition device of FIG. 2*a* may be provided independently of the length recognition devices of FIG. 1*b* and FIG. 3, and with or without any other kind of length recognition device.

Although the foregoing invention has been described in detail by way of illustration and example for purposes of understanding, it will be obvious that changes and modifications may be practised within the scope of the appended claims.

What is claimed is:

1. An apparatus for removing fibre material from textile fibre bales, comprising:

a carriage that is movable in a height direction and a length direction independent of one another for stripping fibre material from the fibre bales;

a distance sensor that is movable with the carriage; and a counter-surface;

wherein the distance between the distance sensor and the counter-surface varies in use according to the location of the carriage and the distance sensor is arranged to scan the distance to the counter-surface for determining a location of the carriage.

2. An apparatus according to claim 1, in which the counter-surface is a counter-surface that is immovable.

3. An apparatus according to claim 2, in which the counter-surface is inclined relative to the length direction and the scanned distance between the sensor and the counter-surface is usable to determine the location of the carriage in the length direction.

4. An apparatus according to claim 3, in which the distance sensor for the length direction is mounted on the movable carriage or on a tower located on the carriage.

5. An apparatus according to claim 3, in which a counterpart element for the length direction comprising said counter-surface is associated with a spinning room floor.

6. An apparatus according to claim 1, in which the distance sensor for location determination in the length direction is mounted at an angle of 90° to a base surface of a counterpart element comprising said counter-surface.

7. An apparatus according to claim 2, in which the counter-surface is inclined relative to the height direction and the scanned distance between the sensor and the counter-surface is usable to determine the location of the carriage in the height direction.

8. An apparatus according to claim 7, in which the distance sensor for the height direction is mounted on a movable stripper or on a tower located on the carriage.

9. An apparatus according to claim 1, which comprises:

a first sensor and a first counter-surface for determining the location of the carriage in the height direction; and a second sensor and a second counter-surface for determining the location of the carriage in the length direction;

wherein at least one of the first and second counter-surfaces is an immovable surface that is inclined relative to the respective direction.

10. An apparatus according to claim 1, comprising a counterpart element that includes as said counter-surface a flat scanning surface.

11. An apparatus according to claim 7, in which the inclined surface is produced by milling carried out on a structural element of the machine.

12. An apparatus according to claim 1, in which a stationary distance sensor is arranged opposite a wound-on part of a covering band for a suction duct for the removed fibre tufts.

13. An apparatus according to claim 12, in which a counterpart element is arranged on or in the vicinity of the suction duct.

14. An apparatus according to claim 1, wherein the distance sensor comprises an optical sensor.

15. An apparatus according to claim 14, in which the optical sensor is selected from the group consisting of laser scanners, distance sensors that use visible light, and distance sensors that use infra-red light.

16. An apparatus according to claim 1, wherein the distance sensor comprises a sensor having a transmitter and a receiver.

17. An apparatus according to claim 1, in which a movable cleaning element is associated with the counter-surface.

18. An apparatus according to claim 1, in which the distance sensor and the counter-surface element are arranged in an enclosed housing.

19. An apparatus according to claim 1, in which the distance sensor is in communication with an electrical evaluation device and/or an electronic control and regulation device.

20. An apparatus according to claim 1, in which the counter-surface comprises an immovable inclined surface and an evaluation device, located at a prespecified distance between the distance sensor and a reference surface and prespecified angle of inclination between the reference surface and the counter-surface, wherein the evaluation device calculates the location from the distance between the distance sensor and the inclined counter-surface.

21. An apparatus according to claim 1, in which the distance sensor comprises a sensor that operates in an analogue manner.

* * * * *